US009303927B2

(12) United States Patent
Yang et al.

(10) Patent No.: US 9,303,927 B2
(45) Date of Patent: Apr. 5, 2016

(54) HEAT SPREADER STRUCTURE AND MANUFACTURING METHOD THEREOF

(75) Inventors: Hsiu-Wei Yang, New Taipei (TW); Ming-Tai Weng, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 911 days.

(21) Appl. No.: 13/176,752

(22) Filed: Jul. 6, 2011

(65) Prior Publication Data

US 2012/0305222 A1 Dec. 6, 2012

(30) Foreign Application Priority Data

May 31, 2011 (TW) ..... 100119075 A

(51) Int. Cl.
*F28D 15/04* (2006.01)

(52) U.S. Cl.
CPC ..... *F28D 15/046* (2013.01); *Y10T 29/4935* (2015.01)

(58) Field of Classification Search
CPC ..... F28D 15/04; F28D 15/046
USPC ..... 165/104.21, 104.26, 80.5, 80.4, 104.33
See application file for complete search history.

(56) References Cited

U.S. PATENT DOCUMENTS

| | | | | |
|---|---|---|---|---|
| 6,269,866 | B1 * | 8/2001 | Yamamoto et al. | 165/104.26 |
| 7,066,240 | B2 * | 6/2006 | Dussinger et al. | 165/104.26 |
| 7,609,520 | B2 * | 10/2009 | Chang et al. | 361/700 |
| 8,377,214 | B2 * | 2/2013 | Zhang et al. | 118/733 |
| 2007/0068657 | A1 * | 3/2007 | Yamamoto et al. | 165/104.26 |
| 2009/0025910 | A1 * | 1/2009 | Hoffman et al. | 165/104.26 |
| 2010/0006268 | A1 * | 1/2010 | Meyer et al. | 165/104.26 |
| 2010/0263835 | A1 * | 10/2010 | Wang | 165/104.26 |

* cited by examiner

*Primary Examiner* — Ljilana Ciric
*Assistant Examiner* — John Higgins
(74) *Attorney, Agent, or Firm* — C. G. Mersereau; Nikolai & Mersereau, P.A.

(57) ABSTRACT

A heat spreader structure and a manufacturing method thereof. The heat spreader structure includes a main body. The main body includes a first board body and a second board body corresponding to the first board body. The second board body is mated with the first board body to form the main body. The main body has a circulation area and a connection area. The circulation area is connected with the connection area to together define a chamber in which a working fluid is contained. The circulation area has a first capillary structure, while the connection area has a second capillary structure. In manufacturing, the heat spreader structure can be freely bent and shaped without damaging the internal capillary structures.

5 Claims, 14 Drawing Sheets

HEAT SPREADER STRUCTURE AND MANUFACTURING METHOD THEREOF

This application claims the priority benefit of Taiwan patent application number 100119075 filed on May 31, 2011.

BACKGROUND OF THE INVENTION

1. Field of the Invention

The present invention relates generally to a heat spreader structure and a manufacturing method thereof. A bendable capillary structure is disposed on a part of the heat spreader structure to be bent, whereby the heat spreader structure can be bent without damaging the internal capillary structures.

2. Description of the Related Art

There is a trend to slim the electronic devices. To catch up this trend, the electronic components of the electronic devices must be miniaturized with the electronic devices. While reducing the size of the semiconductors that compose the electronic components, the electronic devices are still required to have advanced performance. In this case, it has become a critical topic how to efficiently dissipate heat generated by the electronic components.

The miniaturization of the semiconductors will lead to increase of heat flux. The increase of heat flux will cause overheating of the electronic components. Therefore, the heat generated by the electronic components must be dissipated at high efficiency. Otherwise, the electronic components may fail or even burn out.

In order to efficiently dissipate the heat, various heat spreaders with different sizes and forms are applied to different electronic components. The heat spreader must be bent or formed with a special configuration in adaptation to the heat source. However, the heat spreader has an internal capillary structure. When an external force is applied to the heat spreader to shape the same, the internal capillary structure of the heat spreader may be damaged. This will affect the vapor/liquid circulation efficiency of the working fluid or even lead to failure of the heat spreader.

It can be known from the above that it is uneasy or even impossible to bend and shape the conventional heat spreader. For manufacturing a heat spreader with a special configuration, it is necessary to first bend the upper and lower cover bodies into a desired shape and then sinter the capillary structure. Such process is complicated and the manufacturing cost is higher. Accordingly, the conventional heat spreader has the following shortcomings:

1. The product can be hardly bent and shaped.
2. The manufacturing cost is higher.
3. The manufacturing process is complicated.

SUMMARY OF THE INVENTION

A primary object of the present invention is to provide a heat spreader structure, which can be bent and shaped.

A further object of the present invention is to provide a manufacturing method of a heat spreader structure, which can be bent and shaped.

To achieve the above and other objects, the heat spreader structure of the present invention includes a main body. The main body includes a first board body and a second board body corresponding to the first board body. The second board body is mated with the first board body to form the main body.

The main body has a circulation area and a connection area. The circulation area is connected with the connection area to together define a chamber in which a working fluid is contained. The circulation area has a first capillary structure, while the connection area has a second capillary structure.

The manufacturing method of the heat spreader structure of the present invention steps of:

preparing a first board body and a second board body;

defining the first and second board bodies with at least one circulation area and at least one connection area;

disposing a first capillary structure on the circulation area and disposing a second capillary structure on the connection area;

mating the first and second board bodies to form a heat spreader with a chamber;

bending the connection area of the heat spreader vacuuming the chamber of the heat spreader and filling a working fluid into the chamber; and sealing the heat spreader.

According to the heat spreader structure of the present invention and by means of the manufacturing method thereof, after formed, the heat spreader structure can be freely bent and shaped without damaging the internal capillary structures. Accordingly, the heat spreader structure can be more flexibly shaped and the manufacturing time is shortened.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
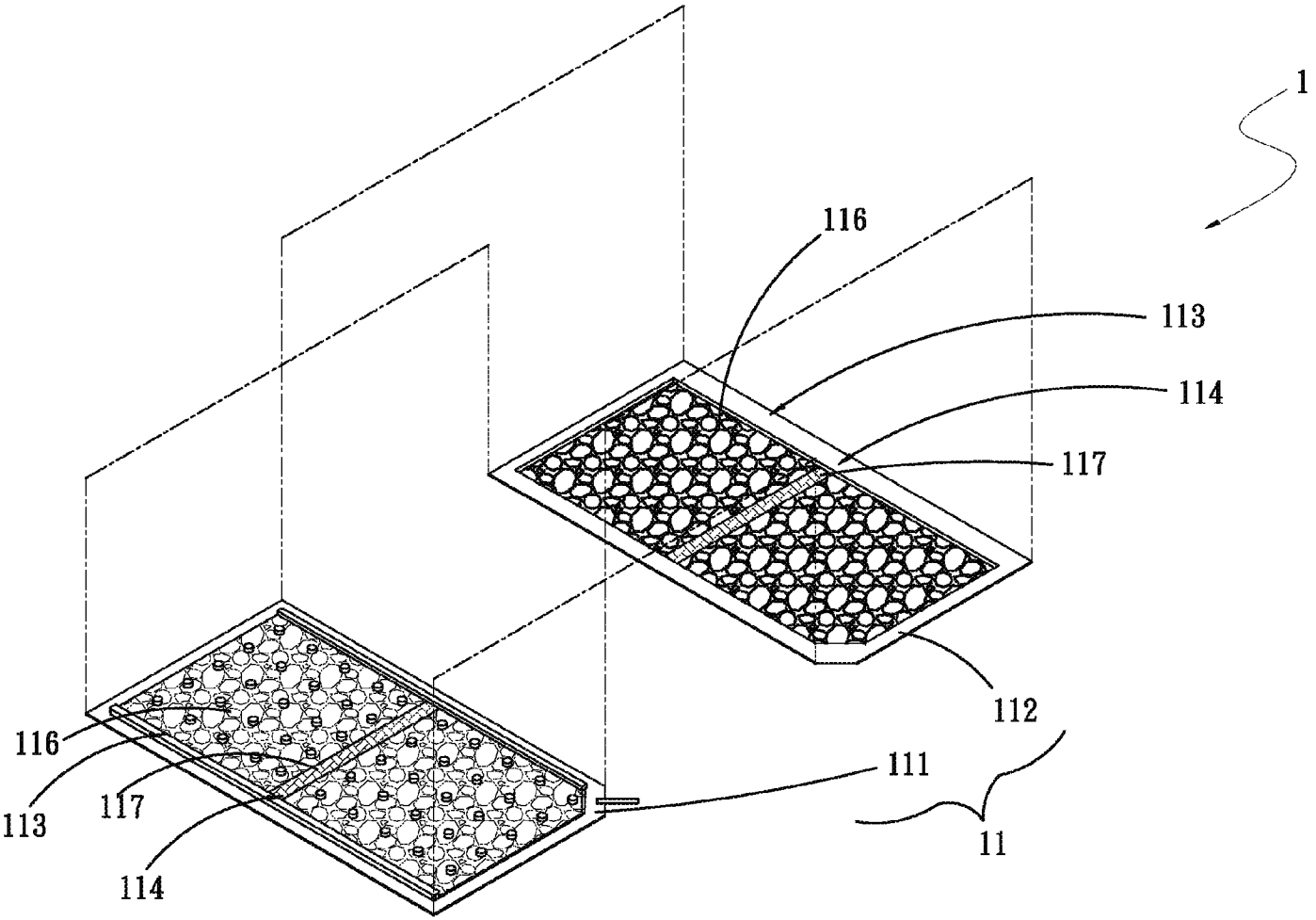
FIG. 1 is a perspective exploded view of a first embodiment of the heat spreader structure of the present invention.
Figure 2:
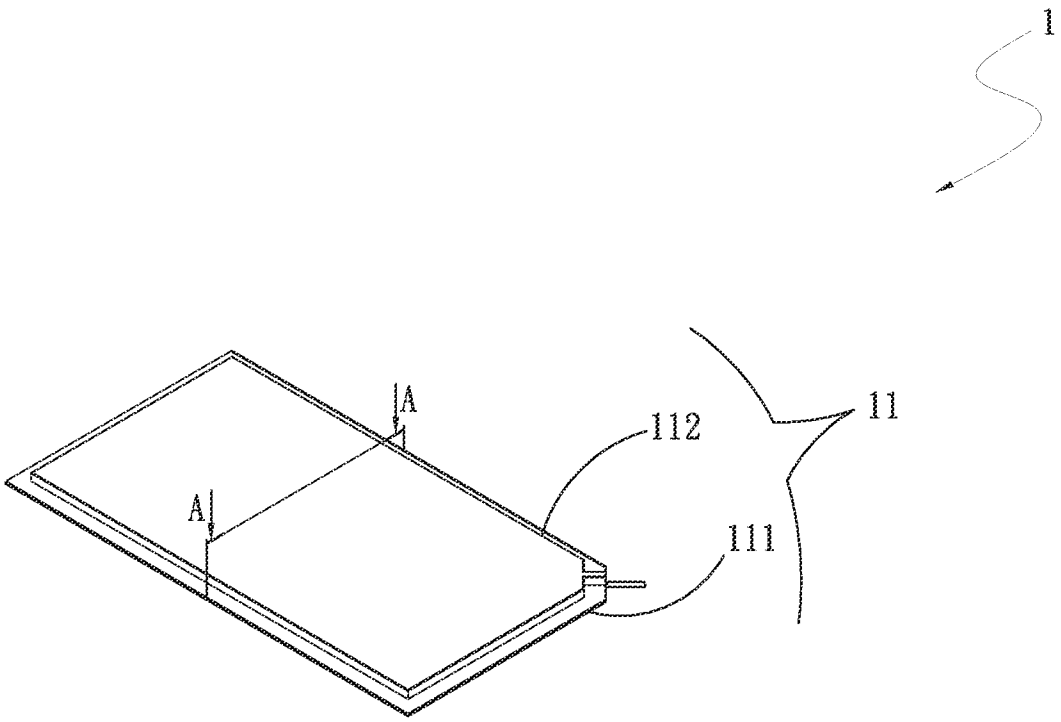
FIG. 2 is a perspective assembled view of the first embodiment of the heat spreader structure of the present invention.
Figure 3:
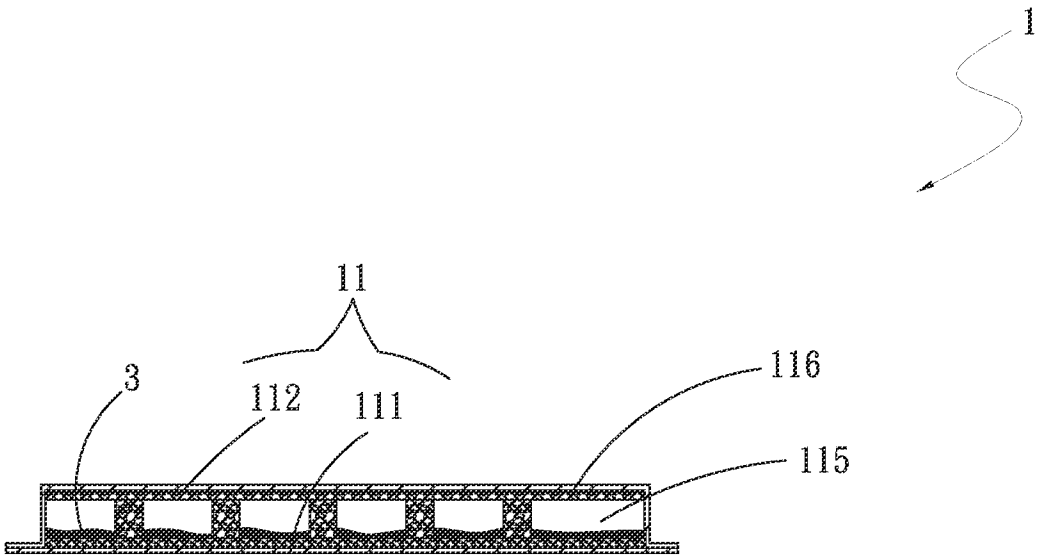
FIG. 3 is a sectional view taken along line A-A of FIG. 2.
Figure 4:
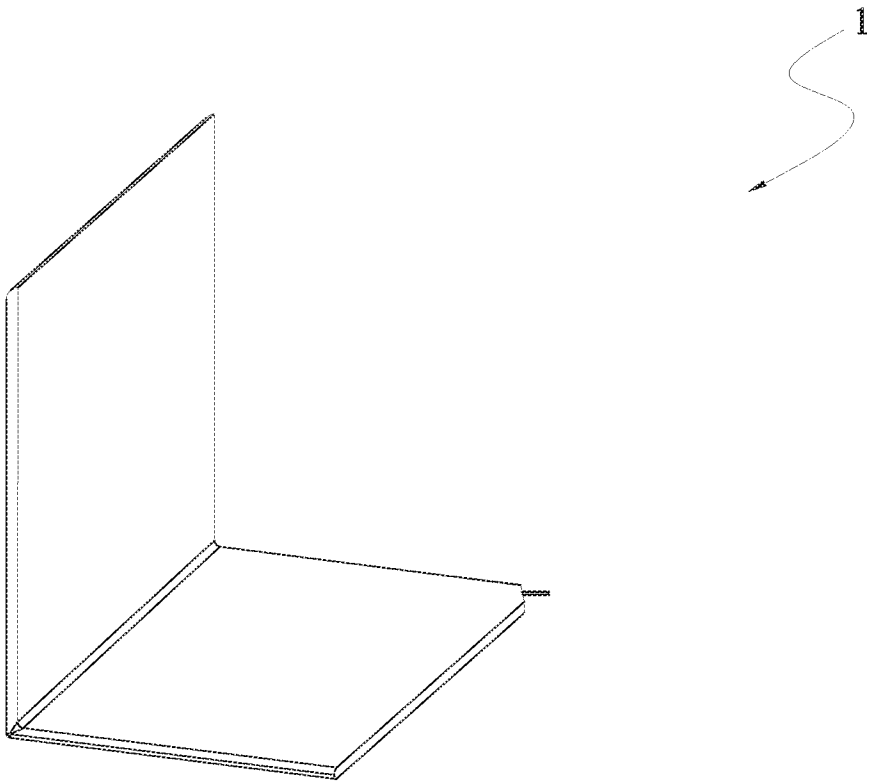
FIG. 4 shows that the first embodiment of the heat spreader structure of the present invention is bent.

Please refer to FIGS. 1, 2, 3 and 4. FIG. 1 is a perspective exploded view of a first embodiment of the heat spreader structure of the present invention. FIG. 2 is a perspective assembled view of the first embodiment of the heat spreader structure of the present invention. FIG. 3 is a sectional view taken along line A-A of FIG. 2. FIG. 4 shows that the first embodiment of the heat spreader structure of the present invention is bent. According to the first embodiment, the heat spreader structure 1 of the present invention includes a main body 11.

The main body 11 includes a first board body 111 and a second board body 112 corresponding to the first board body 111. The second board body 112 is mated with the first board body 111 to form the main body 11.

The main body 11 has a circulation area 113 and a connection area 114. The circulation area 113 is connected with the connection area 114 to together define a chamber 115 in which a working fluid 3 is contained. The circulation area 113 has a first capillary structure 116, while the connection area 114 has a second capillary structure 117.

The first capillary structure 116 is composed of a powder sintered body and multiple support pillars connected with the powder sintered body. The support pillar is selected from a group consisting of powder sintered pillar and copper pillar.

Figure 5:
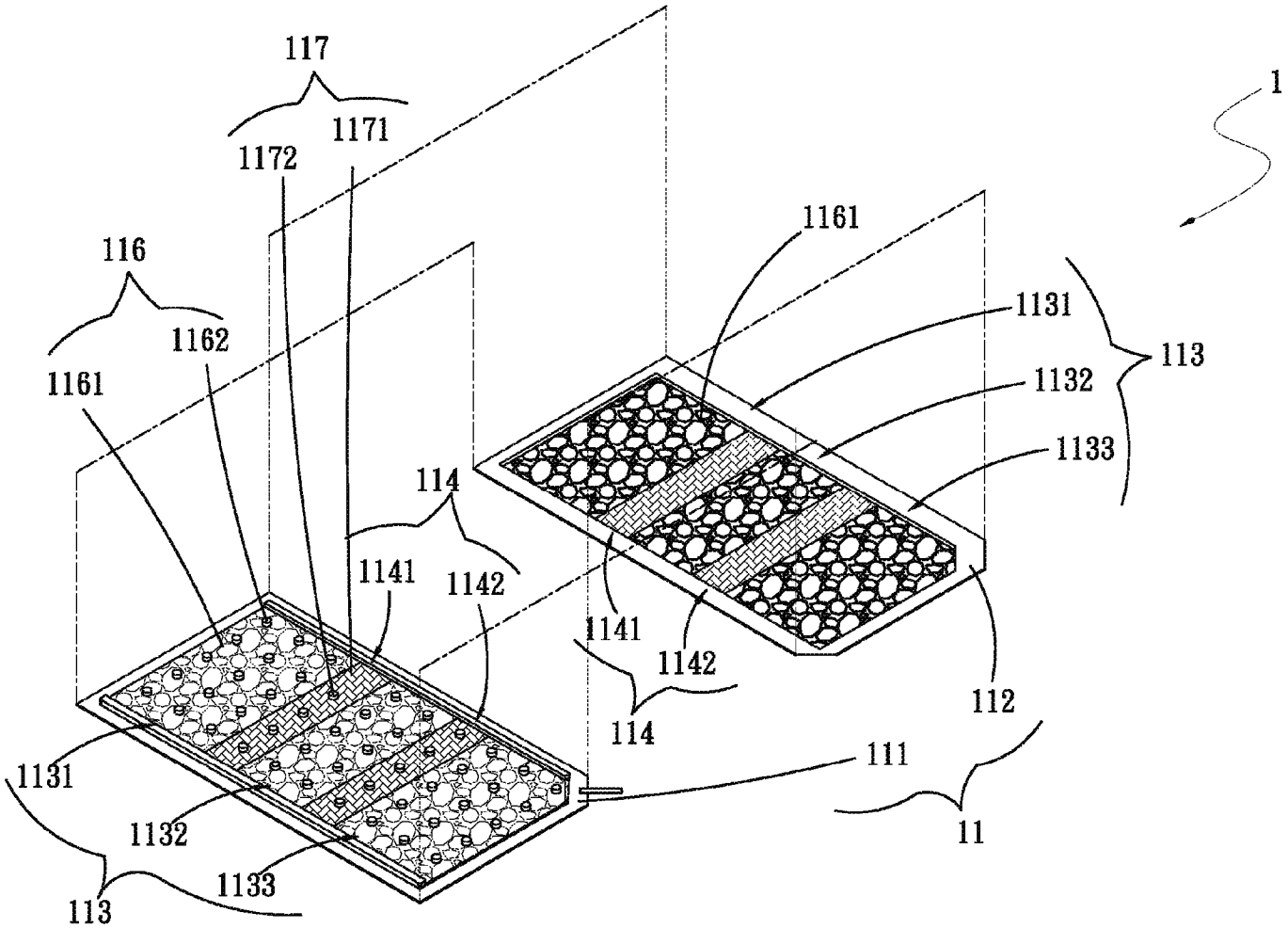
FIG. 5 is a perspective exploded view of a second embodiment of the heat spreader structure of the present invention.
Figure 6:
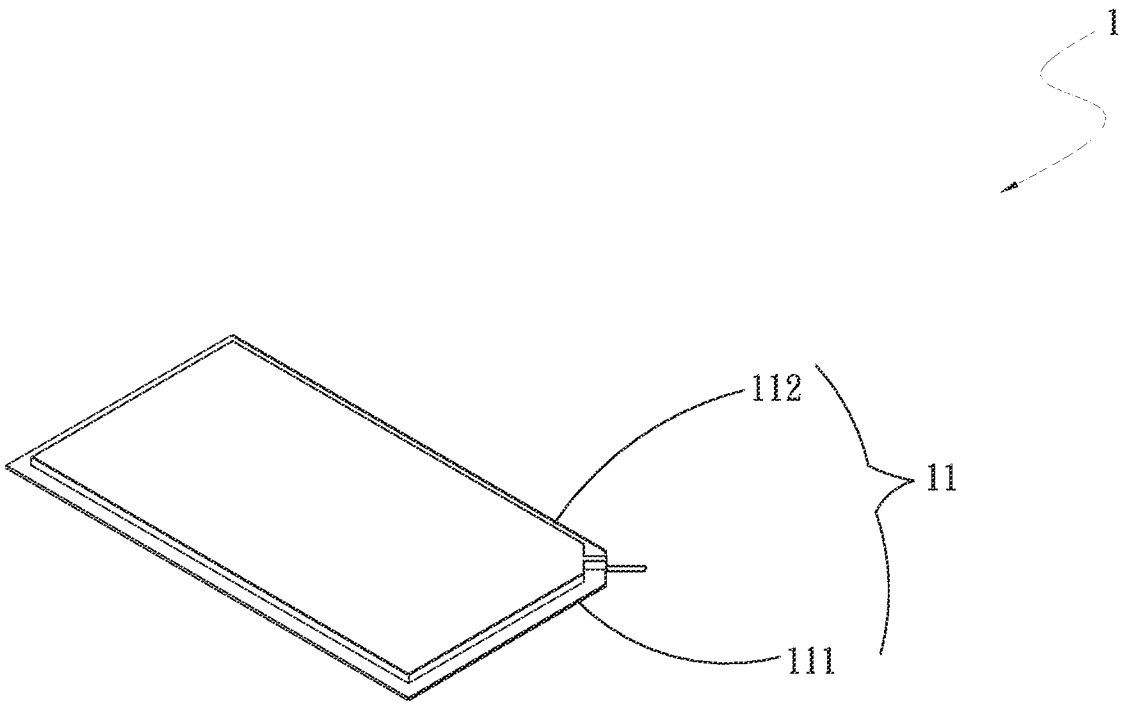
FIG. 6 is a perspective assembled view of the second embodiment of the heat spreader structure of the present invention.
Figure 7:
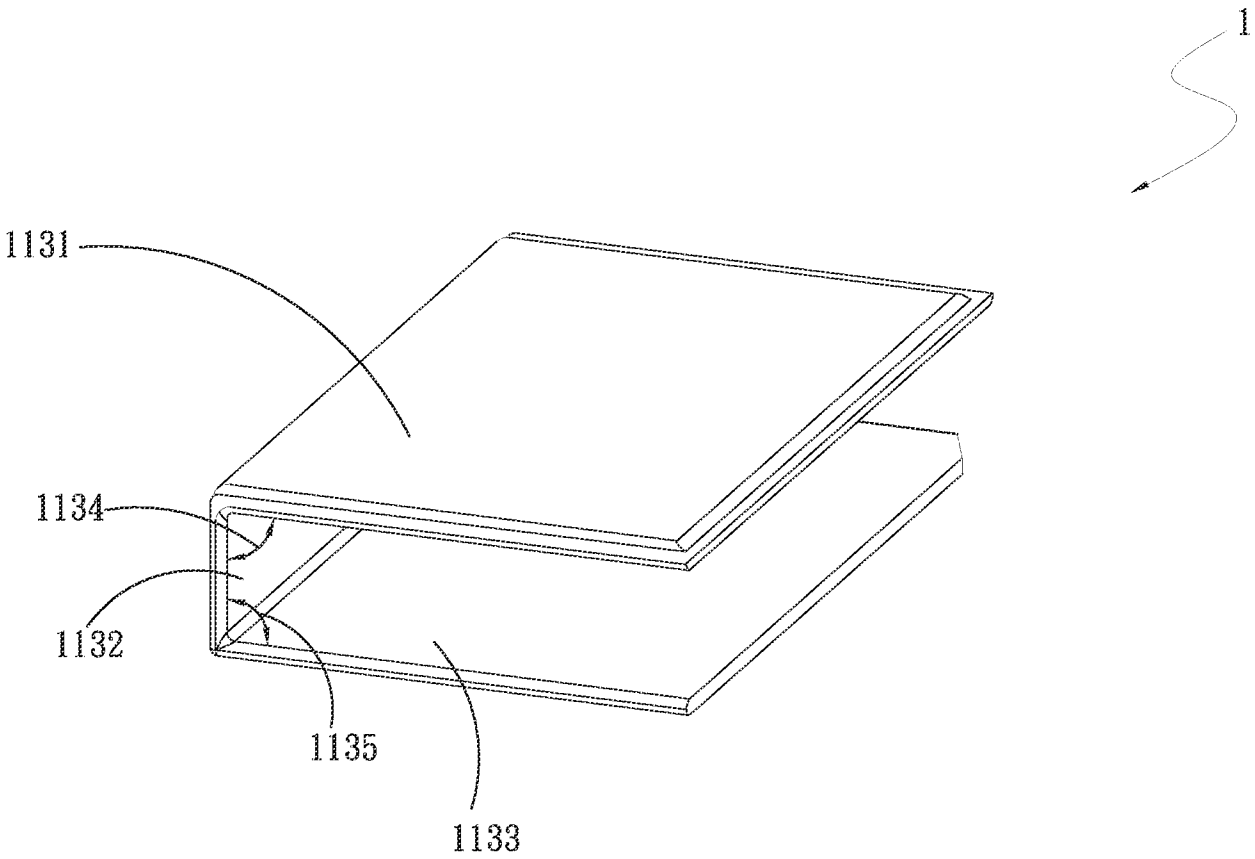
FIG. 7 shows that the second embodiment of the heat spreader structure of the present invention is bent.
Figure 8A:
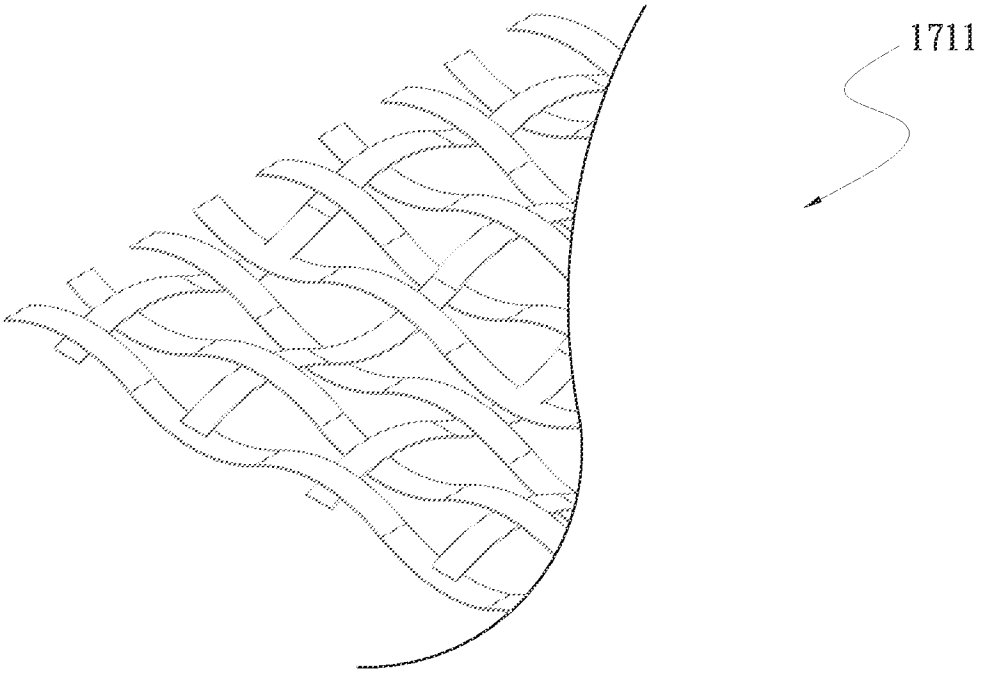
FIG. 8*a* is perspective view of the support board of the present invention in a first aspect.
Figure 8B:
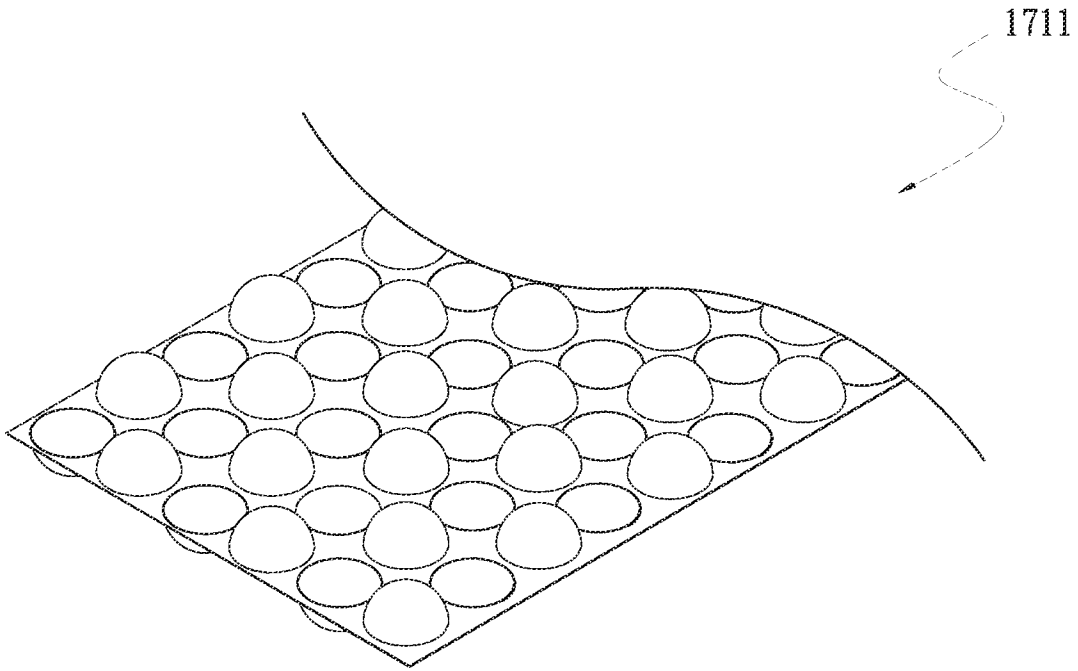
FIG. 8*b* is perspective view of the support board of the present invention in a second aspect.
Figure 8C:
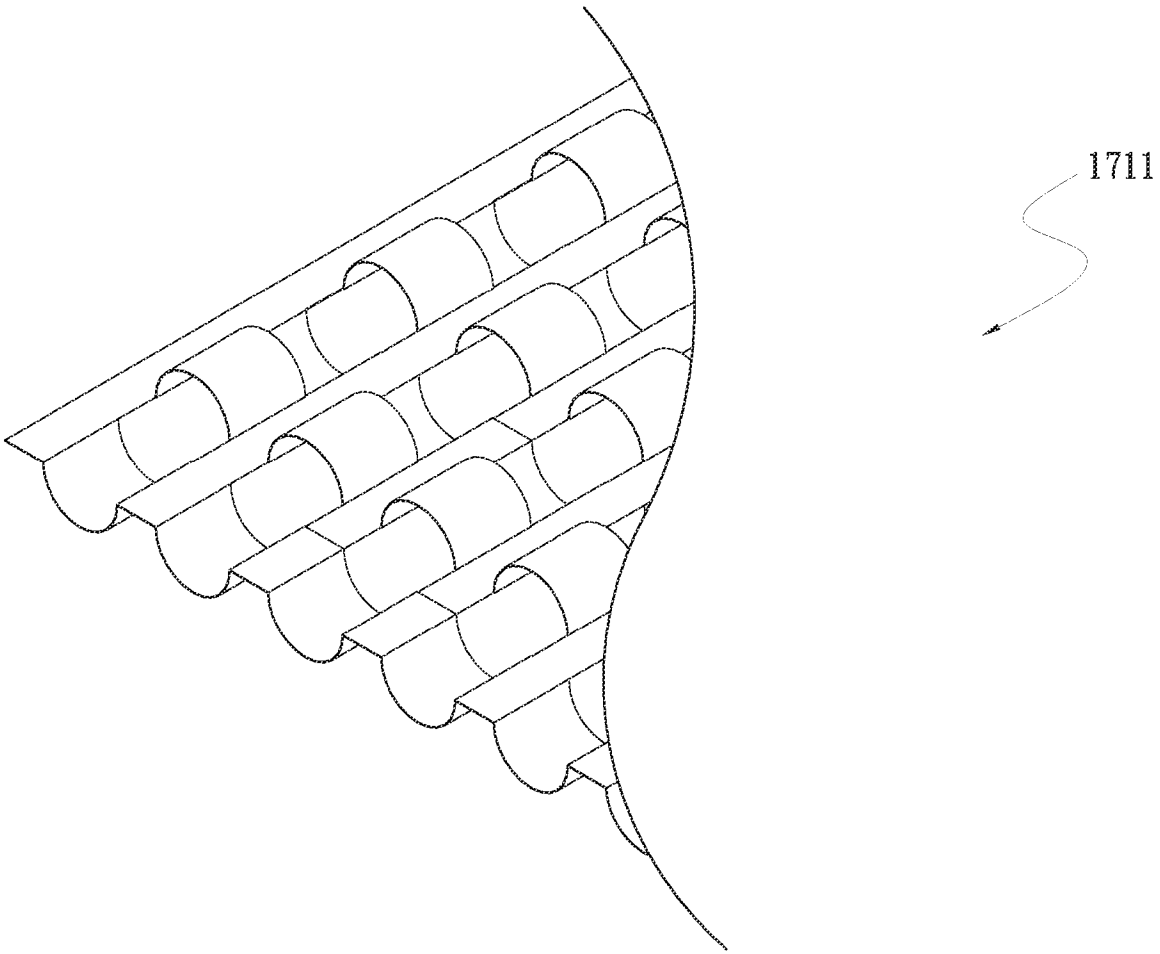
FIG. 8*c* is perspective view of the support board of the present invention in a third aspect.

Please refer to FIGS. 5, 6, 7, 8*a*, 8*b* and 8*c*. FIG. 5 is a perspective exploded view of a second embodiment of the heat spreader structure of the present invention. FIG. 6 is a perspective assembled view of the second embodiment of the heat spreader structure of the present invention. FIG. 7 shows that the second embodiment of the heat spreader structure of the present invention is bent. FIG. 8*a* is perspective view of the support board of the present invention in a first aspect. FIG. 8*b* is perspective view of the support board of the present invention in a second aspect. FIG. 8*c* is perspective view of the support board of the present invention in a third aspect. The second embodiment is substantially identical to the first embodiment and thus will not be repeatedly described hereinafter. The second embodiment is different from the first embodiment in that the circulation area 113 includes a first circulation section 1131, a second circulation section 1132 and a third circulation section 1133. The connection area 114 includes a first connection section 1141 and a second connection section 1142. The first connection section 1141 is disposed between the first and second circulation sections 1131, 1132, while the second connection section 1142 is disposed between the second and the third circulation sections 1132, 1133.

The first capillary structure 116 is disposed on first, second and third circulation sections 1131, 1132, 1133, while the second capillary structure 117 is disposed on the first and second connection sections 1141, 1142.

The first capillary structure 116 is composed of a powder sintered body 1161 and multiple support pillars 1162 connected with the powder sintered body 1161. The support pillar 1162 is selected from a group consisting of powder sintered pillar and copper pillar.

The second capillary structure 117 is formed of a support board 1171 or composed of the support board 1171 and multiple support pillars 1172 connected with the support board 1171.

The support board 1171 is selected from a group consisting of mesh body (as shown in FIG. 8*a*), board material having recessed/raised sections on its surface (as shown in FIG. 8*b*) and waved board body (as shown in FIG. 8*c*).

The first and second circulation sections 1131, 1132 contain a first angle 1134, while the second and third circulation sections 1132, 1133 contain a second angle 1135. The first and second angles 1134, 1135 are larger than 0 degree but smaller than 90 degrees.

Figure 9:
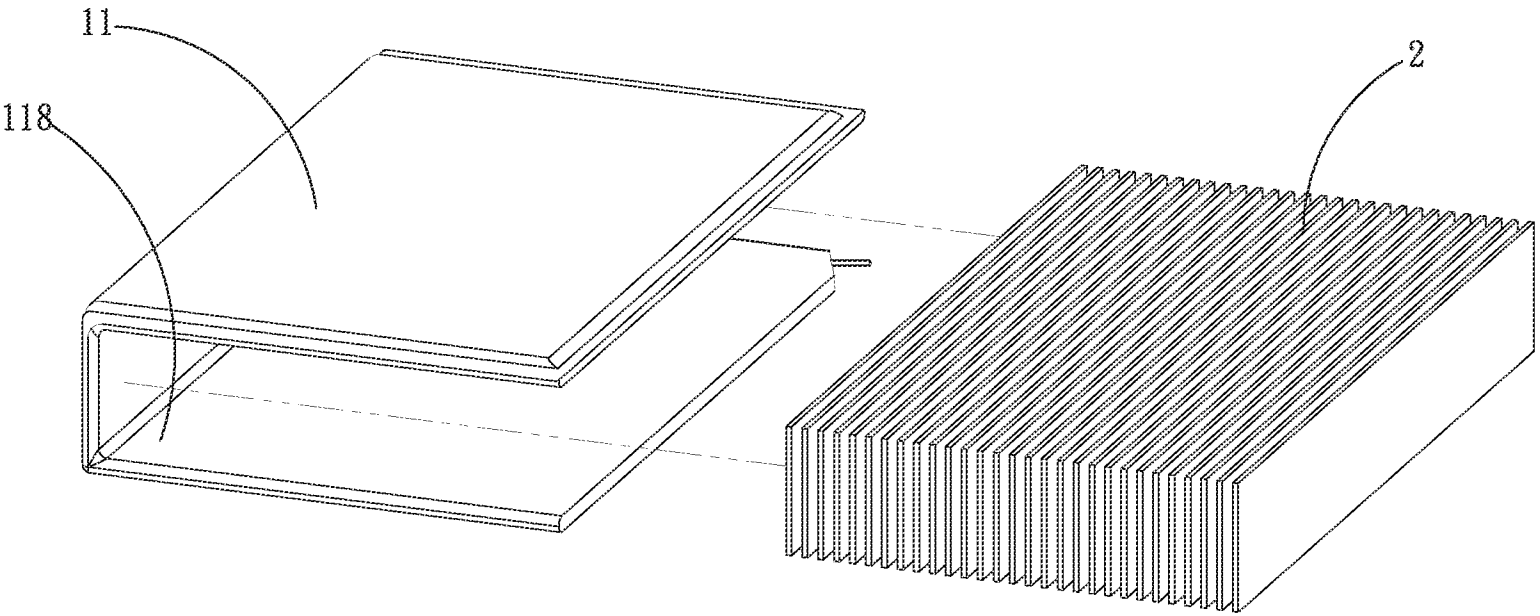
FIG. 9 shows the application of the heat spreader structure of the present invention.
Figure 10:
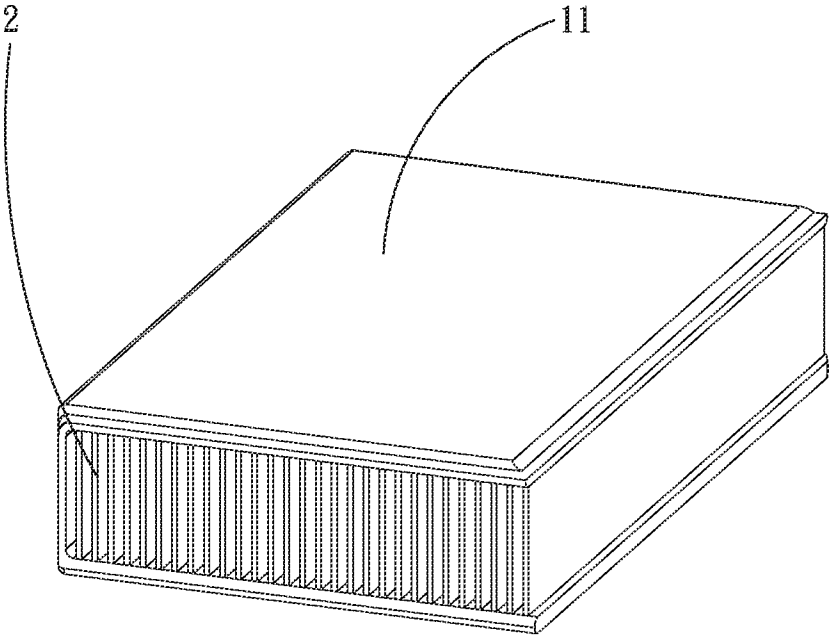
FIG. 10 also shows the application of the heat spreader structure of the present invention.

Please refer to FIGS. 9 and 10, which show the application of the heat spreader structure of the present invention. The main body 11 further has a heat dissipation section 118 mated with a heat dissipation unit 2. The heat dissipation unit 2 is selected from a group consisting of heat sink and radiating fin assembly. In this embodiment, the heat dissipation unit is, but not limited to, a radiating fin assembly.

Figure 11:
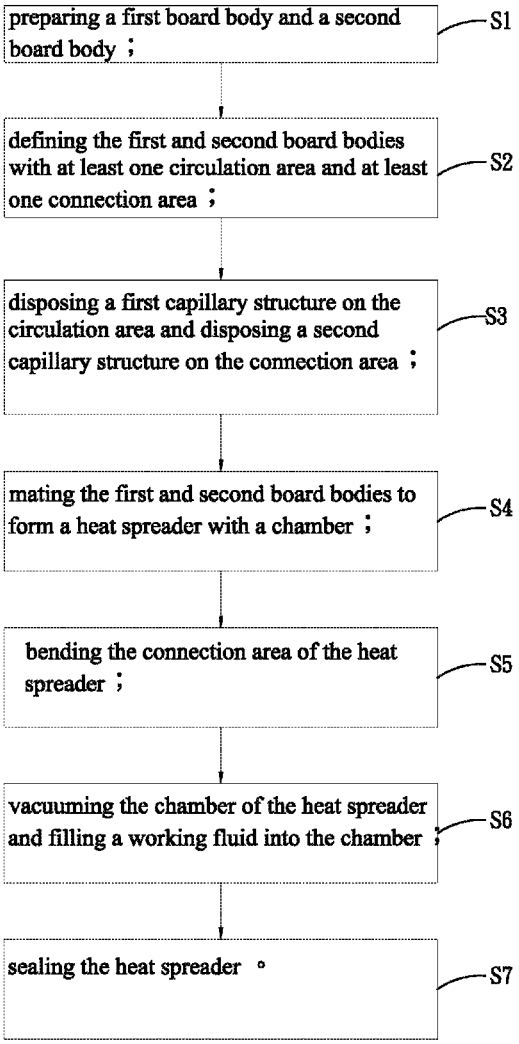
FIG. 11 is a flow chart of a first embodiment of the manufacturing method of the heat spreader structure of the present invention.

Please refer to FIG. 11, which is a flow chart of a first embodiment of the manufacturing method of the heat spreader structure of the present invention. Also referring to FIGS. 1 to 7, the manufacturing method of the heat spreader structure of the present invention includes steps of:

S1: preparing a first board body and a second board body, a first board body 111 and a second board body 112 being prepared, the first and second board bodies 111, 112 being made of copper, aluminum or any other material with good thermal conductivity, in this embodiment, the first and second board bodies 111, 112 being made of, but not limited to, copper;

S2: defining the first and second board bodies with at least one circulation area and at least one connection area, a part of the first and second board bodies 111, 112 to be bent being defined as a connection area 114, the other part of the first and second board bodies 111, 112 for transferring heat being defined as a circulation area 113;

S3: disposing a first capillary structure on the circulation area and disposing a second capillary structure on the connection area, a first capillary structure 116 being disposed on the circulation area 113, the first capillary structure 116 being composed of a powder sintered body 1161 and multiple support pillars 1162 connected with the powder sintered body 1161, the support pillar 1162 being selected from a group consisting of powder sintered pillar and copper pillar, the second capillary structure 117 being formed of a support board 1171 or composed of the support board 1171 and multiple support pillars 1172 connected with the support board 1171;

S4: mating the first and second board bodies to form a heat spreader with a chamber, the first and second board bodies 111, 112 being mated with each other to form a heat spreader 1 with a closed chamber 115;

S5: bending the connection area of the heat spreader, the part of the first and second board bodies 111, 112 to be bent, (that is, the connection area 114), being bent;

S6: vacuuming the chamber of the heat spreader and filling a working fluid into the chamber, the chamber 115 of the heat spreader 1 being vacuumed and a working fluid 3 being filled into the chamber 115; and S7: sealing the heat spreader, the heat spreader, which is vacuumed and filled with the working fluid 3 being sealed.

According to the heat spreader structure 1 of the present invention and by means of the manufacturing method thereof, the ratio of good products is increased and the heat spreader structure can be more flexibly designed.

Figure 12:
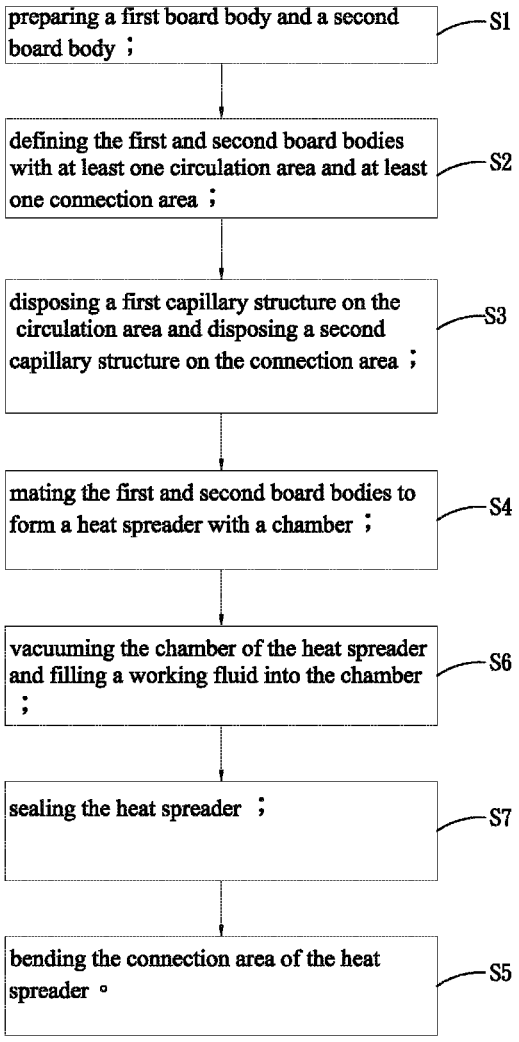
FIG. 12 is a flow chart of a second embodiment of the manufacturing method of the heat spreader structure of the present invention.

Please refer to FIG. 12, which is a flow chart of a second embodiment of the manufacturing method of the heat spreader structure of the present invention. Also referring to FIGS. 1 to 7, the manufacturing method of the heat spreader structure of the present invention includes steps of:

S1: preparing a first board body and a second board body;

S2: defining the first and second board bodies with at least one circulation area and at least one connection area;

S3: disposing a first capillary structure on the circulation area and disposing a second capillary structure on the connection area;

S4: mating the first and second board bodies to form a heat spreader with a chamber;

S6: vacuuming the chamber of the heat spreader and filling a working fluid into the chamber;

S7: sealing the heat spreader; and

S5: bending the connection area of the heat spreader.

The second embodiment of the manufacturing method of the heat spreader structure of the present invention is substantially identical to the first embodiment and thus will not be repeatedly described hereinafter. The second embodiment is different from the first embodiment in that the step of bending the connection area of the heat spreader is performed after the step of sealing the heat spreader 1.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. A heat spreader structure comprising a main body, the main body including a first board body and a second board body corresponding to the first board body, the second board body being mated with the first board body to form the main body, the main body having a circulation area and a connection area, the circulation area being connected with the connection area to together define a chamber in which a working fluid is contained, wherein the circulation area has a first capillary structure, and the connection area has a second capillary structure;

wherein the circulation area includes a first circulation section, a second circulation section and a third circulation section and the connection area includes a first connection section and a second connection section, wherein the first connection section is disposed between and completely separates the first and second circulation sections, and the second connection section is disposed between and completely separates the second and the third circulation sections, the first capillary structure being disposed on the first, second and third circulation sections, and the second capillary structure being disposed on the first and second connection sections, the first capillary structure being composed of a sintered powder body and multiple support pillars connected with the sintered powder body, the support pillars being selected from the group consisting of sintered powder pillars and copper pillars;

wherein the second capillary structure is formed of a support board selected from the group consisting of a support strip and a support strip with multiple support pillars connected with the support strip;

wherein the support strip is selected from the group consisting of a mesh body, a board material having recessed/raised sections on a surface of the board material and a waved board body; and wherein the first and second circulation sections contain a first angle, while the second and third circulation sections contain a second angle, the first and second angles being larger than 0 degree but smaller than 90 degrees.

2. The heat spreader structure as claimed in claim 1, further comprising a heat dissipation section mated with a heat dissipation unit.

3. The heat spreader structure as claimed in claim 2, wherein the heat dissipation unit is a radiating fin assembly.

4. The heat spreader structure as claimed in claim 1, wherein the support pillars are powder sintered pillars.

5. The heat spreader structure as claimed in claim 2, wherein the heat dissipation unit is a heat sink.

* * * * *